US011073364B2

(12) United States Patent
Haole

(10) Patent No.: US 11,073,364 B2
(45) Date of Patent: Jul. 27, 2021

(54) LASER LIPC STUN GUN

(71) Applicant: Kim Wayne Haole, San Jose, CA (US)

(72) Inventor: Kim Wayne Haole, San Jose, CA (US)

( * ) Notice: Subject to any disclaimer, the term of this patent is extended or adjusted under 35 U.S.C. 154(b) by 162 days.

(21) Appl. No.: 16/504,304

(22) Filed: Jul. 7, 2019

(65) Prior Publication Data

US 2020/0217626 A1 Jul. 9, 2020

Related U.S. Application Data

(60) Provisional application No. 62/695,018, filed on Jul. 7, 2018.

(51) Int. Cl.

| | |
|---|---|
| ***F41H 13/00*** | (2006.01) |
| *F41G 3/26* | (2006.01) |
| *F41B 15/04* | (2006.01) |
| *H01T 23/00* | (2006.01) |
| *F41G 1/35* | (2006.01) |

(52) U.S. Cl.

CPC ..... *F41H 13/0012* (2013.01); *F41H 13/00* (2013.01); *F41H 13/005* (2013.01); *F41H 13/0025* (2013.01); *F41B 15/04* (2013.01); *F41G 1/35* (2013.01); *F41G 3/26* (2013.01); *H01T 23/00* (2013.01)

(58) Field of Classification Search

CPC .... F41H 13/00; F41H 13/0012; F41H 13/005; F41H 13/0025; F41G 1/35; F41G 3/26; G09B 19/00; H01T 23/00; F41B 15/04; G21B 1/23

USPC ..... 361/232

See application file for complete search history.

(56) References Cited

U.S. PATENT DOCUMENTS 4,453,196 A * 6/1984 Herr ..... G21B 1/23 361/232

5,675,103 A * 10/1997 Herr ..... F41B 15/04 361/213

* cited by examiner

*Primary Examiner* — Danny Nguyen

(57) ABSTRACT

A non-lethal weapon that delivers a high voltage electrical stun charge to a living organism at a distance without the use of wires, said weapon comprising at least one power laser and a high-voltage electrical circuit, wherein the power laser creates a beam of coherent light that ionizes the air, thus bringing into existence one or more paths of ion-rich gaseous plasma which conduct an electrical stun charge to the living target, and temporarily incapacitate the target.

19 Claims, 12 Drawing Sheets

LASER LIPC STUN GUN

FIELD OF THE INVENTION

This invention is in the field of non-lethal high-voltage personal protection weapons, police apprehension tools, and military anti-personnel weapons. It also has application in the contributory and adjunct use(s) lasers in weapon systems.

BACKGROUND OF THE INVENTION

Stun guns employing very high voltage have been used for some 30 years by police and others to incapacitate an offender. Typically, such stun devices have used compressed gas to shoot small metal darts, which trail wires behind. The darts strike the target and the trailing wires lead back to electrical circuits in the gun. When the darts strike the suspect's skin or clothing, very high voltage electricity is sent from the gun along the wires, shocking the suspect and rendering him or her temporarily helpless.

Such weapons have limited range. They must be reloaded with a new twin-dart cartridge; they lack accuracy; and they are not effective against certain types of clothing or body armor.

The present invention overcomes these obstacles and vastly improves the range and utility of existing stun guns by doing away with darts and wires, and instead using an electrical path of rarified air (ion-rich gaseous plasma) that is temporarily brought into existence by one or more power lasers trained from the stun gun onto the target. The incapacitating high voltage is transmitted along this conductive path of ion-charged air to the target in lieu of being transmitted over an electrical wire or wires.

Virtually every computer user uses lasers routinely to print high quality text and images. Hobbyists have long used the heat generated by lasers to pop balloons and burn through paper. Researchers have used lasers to create ionized paths through the atmosphere as a way to attract lightning. Doctors, machinists, and artists have used the intense and concentrated heat generated by lasers to burn through substances as varied as cancer tumors, wood, and metal—all with great precision and control. And military research has fielded prototype directed-energy weapons using lasers to generate heat at a distance, such as the U.S. Navy's Laser Weapon System (LaWS) deployed in the Persian Gulf aboard the USS Ponce in 2014.

In contrast to directed energy weapons that heat and burn the target, the present invention is a hybrid weapon, employing lasers to generate an electrically conductive path of ionized air leading to the target, and then delivering a high-voltage shock along that plasma path to stun the target. In an ideal embodiment, the present invention is a handheld, portable weapon that can be used as a sidearm or in the form of an infantryman's rifle or "long gun" to deliver an incapacitating shock across a distance.

DETAILED DESCRIPTION OF THE INVENTION

The present invention is a wireless stun-gun type weapon that employs one or more columns of rarified air, created by at least one laser beam to create a thin column of conductive plasma (a gaseous atmospheric plasma with free-moving ions). The rarified air, extending from the invention to the target, is electrically conductive, and transmits a high-voltage charge to the target without the use of wires.

Figure 2:
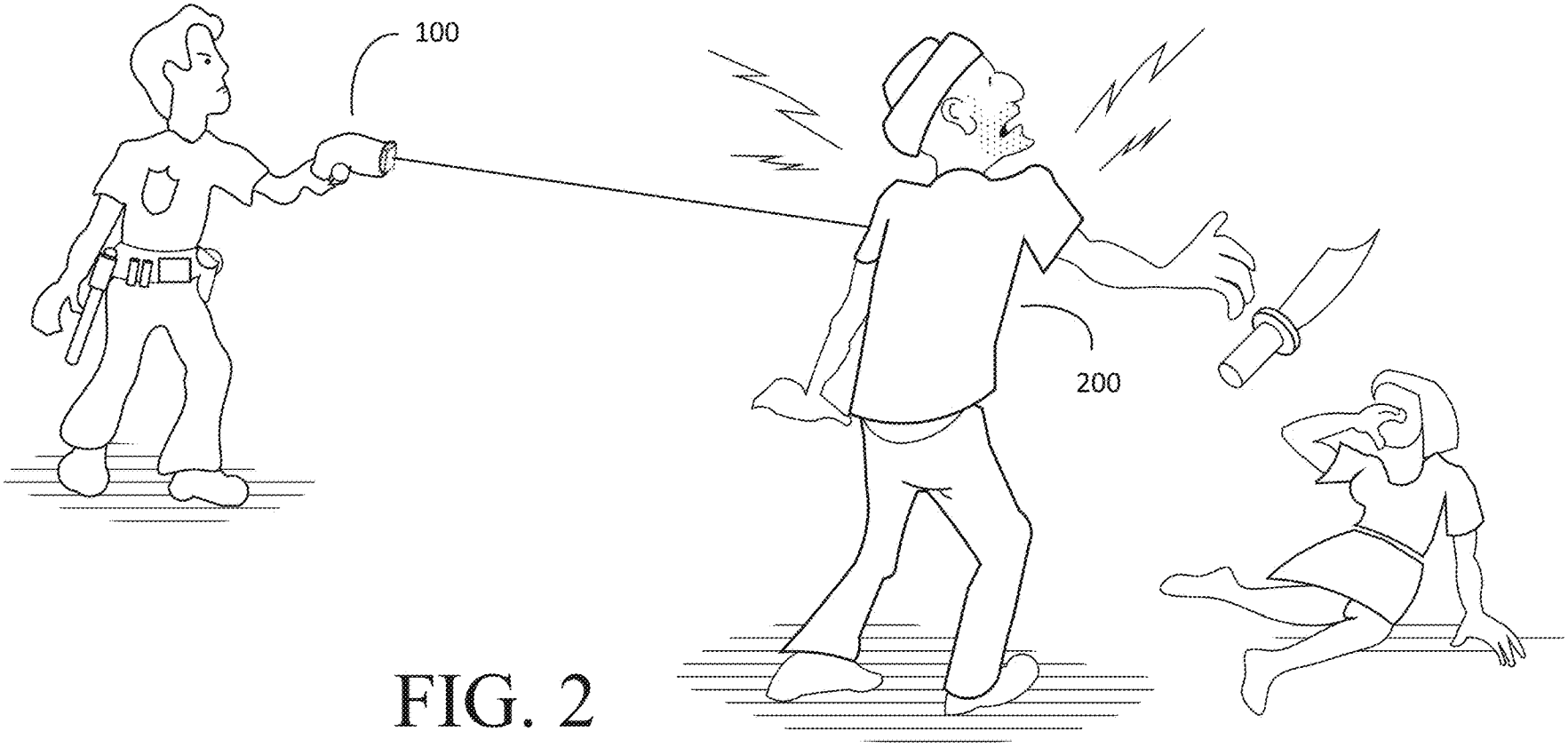
FIG. 2 illustrates a laser stun gun being used in a hypothetical law-enforcement situation.

FIG. 2 illustrates a laser stun gun being used in a hypothetical law-enforcement situation in which non-lethal electric shock is used to halt criminal activity. The laser-produced ionized plasma path(s) from the device 100 to the perpetrator 200 give the weapon range and accuracy that surpasses conventional wire-delivered stun weapons.

Figure 1:
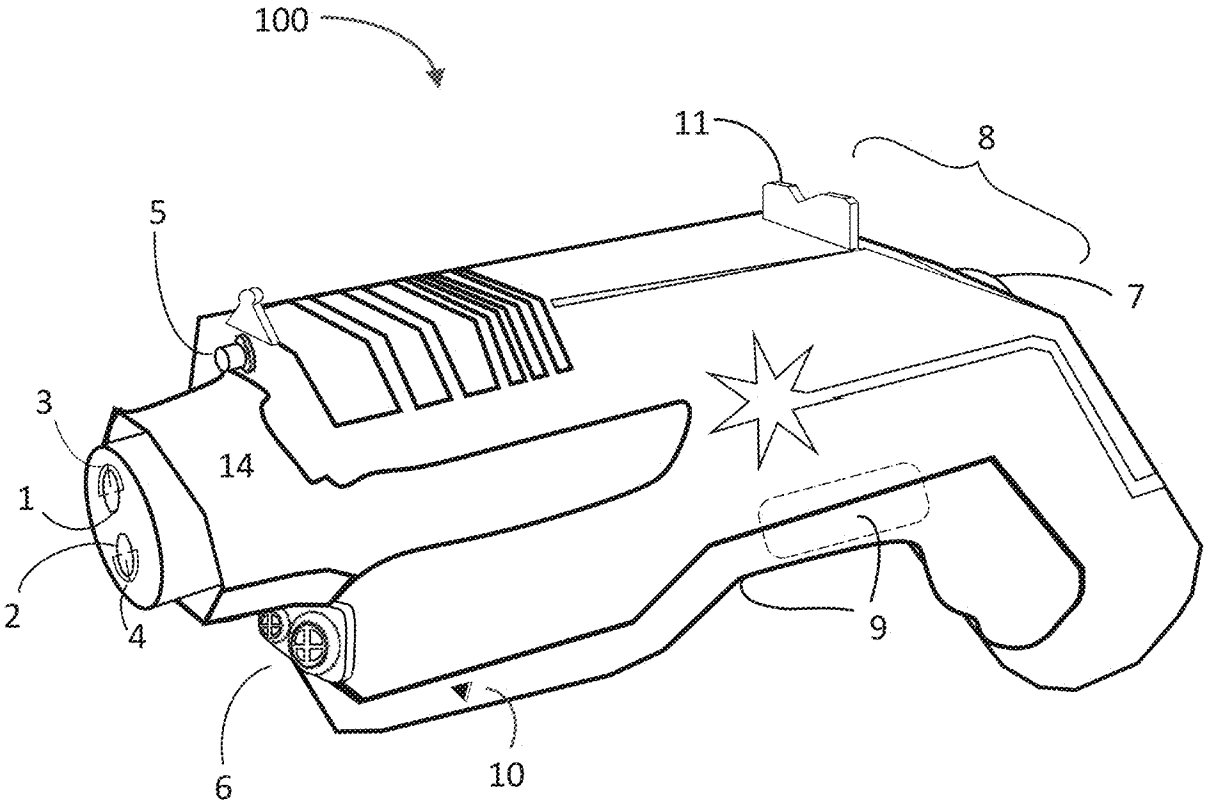
FIG. 1 is a perspective drawing of a design for a laser stun gun, according to an embodiment.
Figure 3:
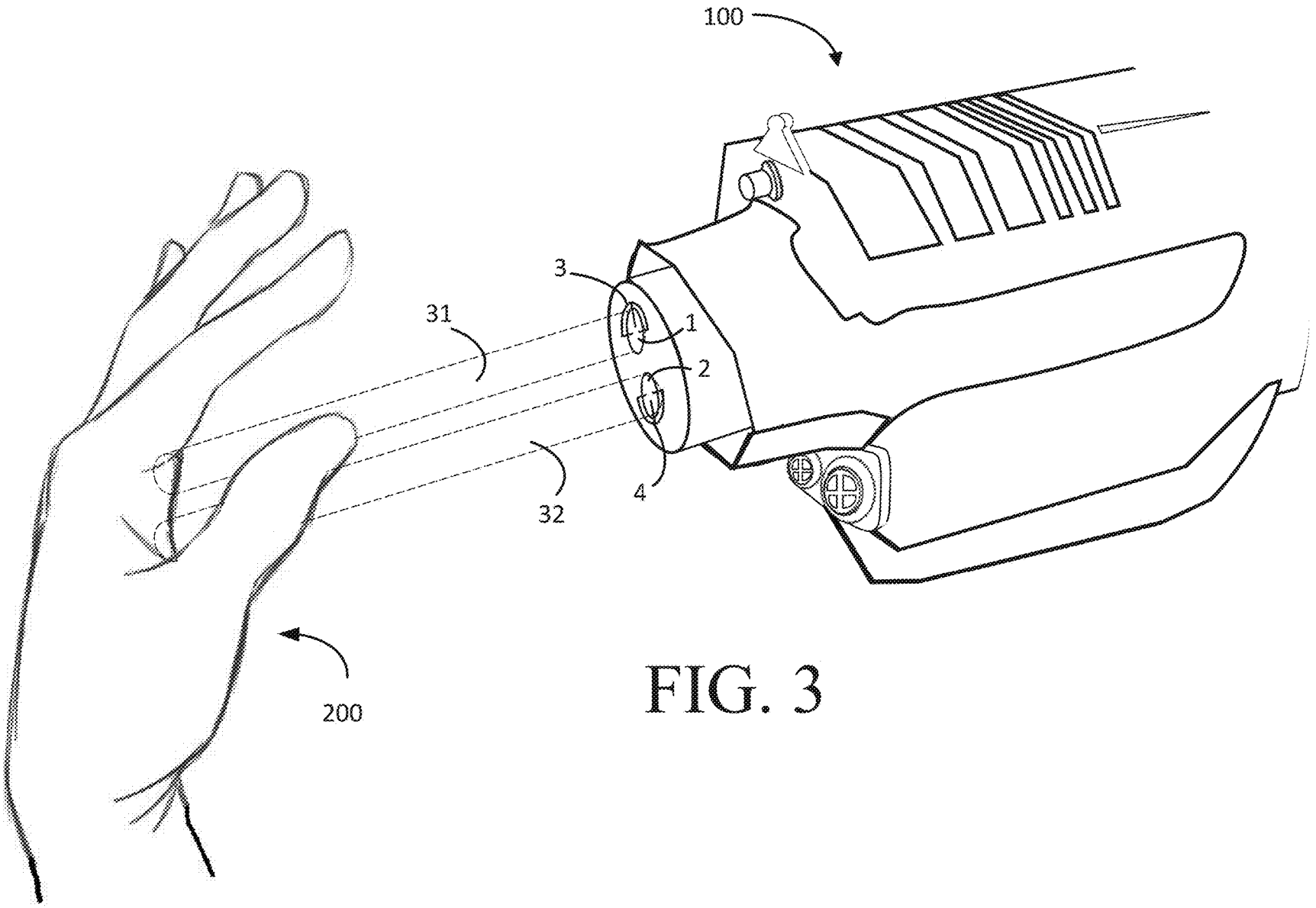
FIG. 3 is a closeup perspective of the muzzle of the laser stun gun depicted in FIG. 2.

FIGS. 1 and 3 illustrate the preferred embodiment of a handheld laser stun gun 100 that uses two parallel laser beams emerging from the twin apertures 1 on the device's muzzle. Device 100 employs a laser or lasers with power sufficient to ionize atmospheric gasses along the length of the laser beams extending from the muzzle to the target.

Unlike some military and advanced research lasers, the laser stun gun 100 does not inflict damage on a target by high-energy burning or cutting. Rather, the laser stun gun uses a laser(s) 1 to ionize atmospheric gases in a path to a target, creating a plasma path or paths that are electrically conductive, and over which an electrical "stun" charge can be delivered to a living target via electrodes 3, 4.

The dual actions of the present invention—creating a plasma path followed instantly by high-voltage electric charge transmitted through ionized air—is, in a sense, like a man-made lightning strike. According to Wikipedia, "In a process not well understood, a bidirectional channel of ionized air, called a 'leader', is initiated between oppositely-charged regions in a thundercloud. Leaders are electrically conductive channels of ionized gas . . . " In thunderclouds, these ionized leaders often split and follow jagged, irregular paths. In nature, when the tip of such a leader reaches an oppositely charged region, a powerful electrical jolt ensues. [https://en.wikipedia.org/wiki/Lightning].

FIG. 2 shows most of the preferred features of the present invention 100. Laser beams emerge from twin apertures 1 and 2. These beams ionize atmospheric air creating electrically conductive pathways to target 200. Electrodes 3 and 4 apply high voltage electrical stun charges to the muzzle ends of the ionized columns.

Figure 9:
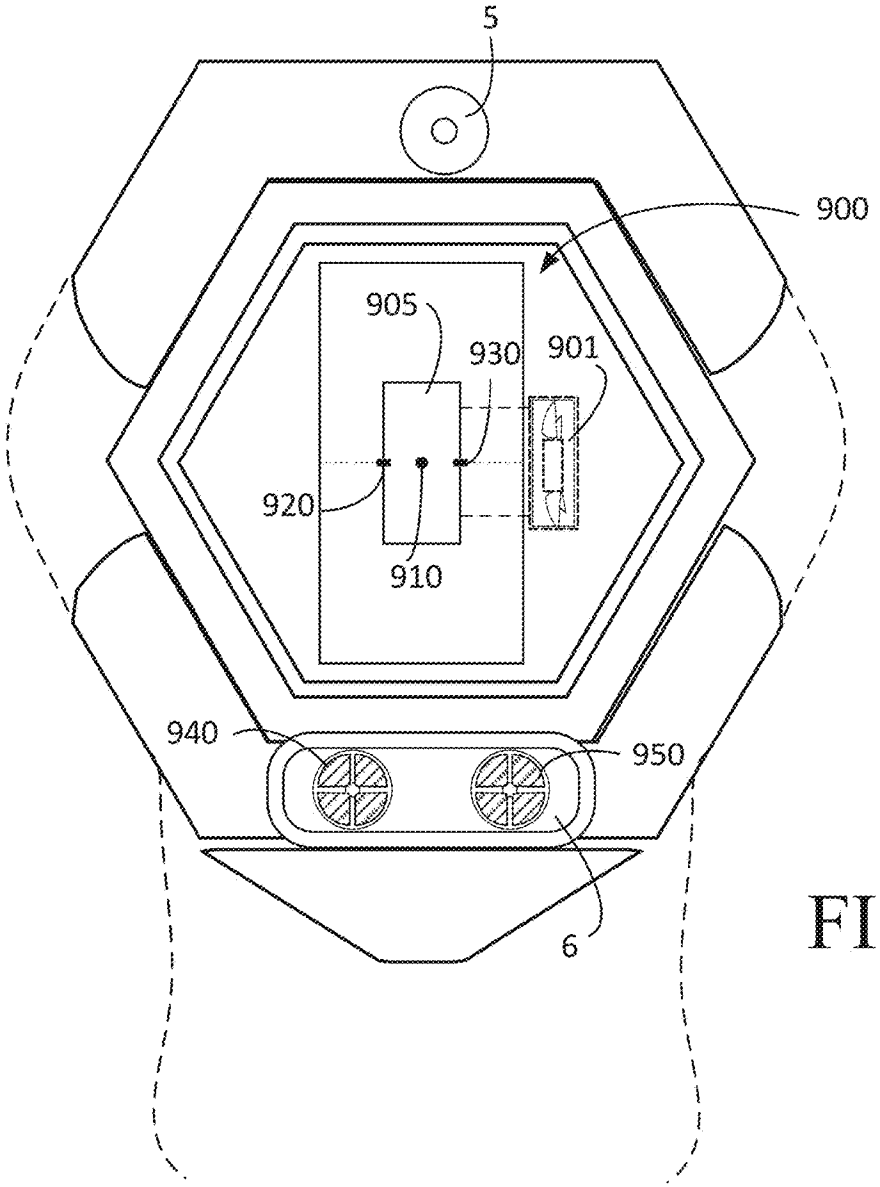
FIG. 9 is a closeup of the discharge end of the laser stun gun according to an alternate embodiment in which the power laser is a long rectangular tube with atmospheric nitrogen being the lasing material.

Safety interlock 9 is a safety switch that activates laser stun gun 100 when it is drawn from a holster or container. In one embodiment (shown in FIGS. 9 and 10) the laser employed is a gaseous nitrogen laser that uses atmospheric gases (composed of 79% nitrogen). In that embodiment, safety interlock 9 turns on the gas circulation fans that supply the $N_2$ laser tube, as depicted in FIG. 9.

The present invention incorporates some prior art technologies but combines them in a unique way to produce novel and unexpected benefits in performance. Sighting laser 5 and laser range system 6 are mounted on the front of the housing well away from the discharge apertures 1, 2 of the laser. Information from the range 6 and targeting laser systems 5 are combined on a user "console" display 8 that is shown obliquely on the slanted handle in FIG. 1. Importantly, console 8 includes the activating Stun button 7. User display and control unit 8 (shown in more detail in FIGS. 11A, 11B, and 11C) provides feedback on target acquisition.

Also shown in FIG. 1 is battery charging port 10 and rear sight 11.

FIG. 3 is a close up perspective view of the muzzle of device 100 at the moment the lasers are firing, showing the laser beams that ionize atmospheric gasses in two columns that impact a living target 200, according to an embodiment.

Electrodes 3 and 4 are situated in close proximity to the front laser apertures and, in fact intrude into the emergent laser beams 31, 32 to establish electrical contact with target 200. A high voltage discharge of millions of volts is triggered to electrodes 3, 4 when the lasers flash. When this stun charge encounters conductive paths connected to a living target, a significant amount of the charge is routed to the target. This miniature man-made "lightning strike" temporarily incapacitates the target, in a manner similar to that produced by a Taser® or other conventional stun gun.

Figure 4:
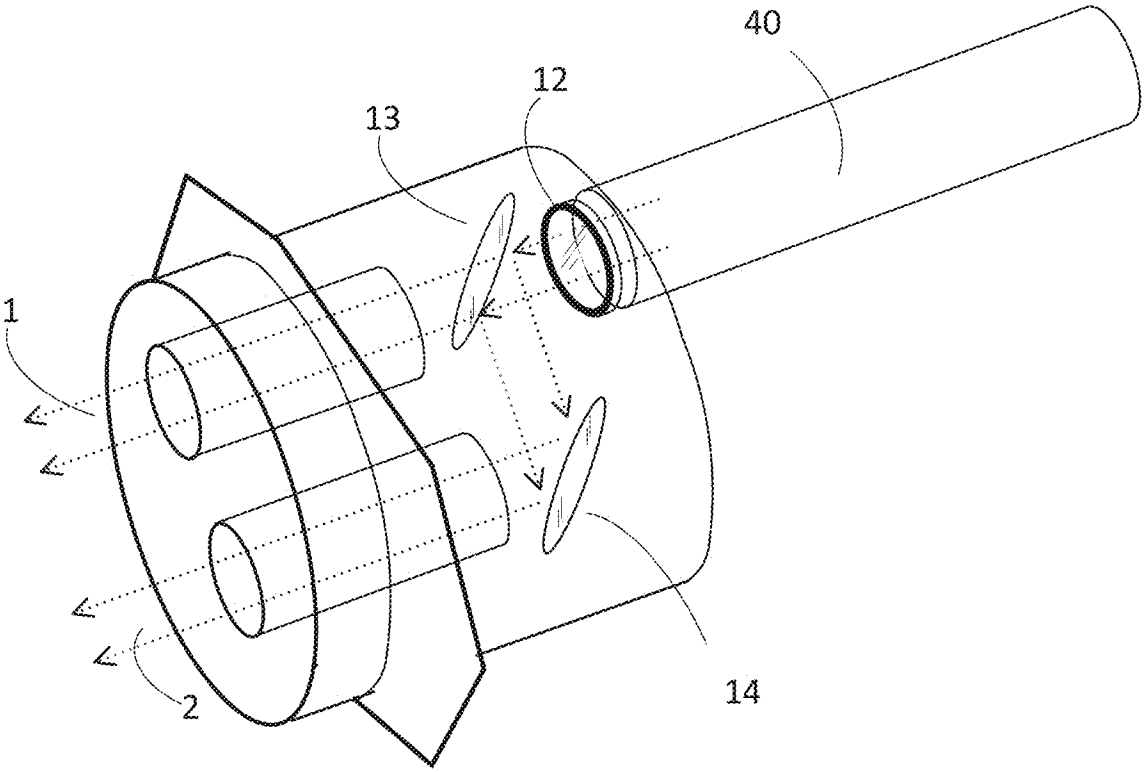
Prior Art FIG. 4
FIG. 4 depicts two prior art techniques used in an embodiment of the present invention: a beam splitter to create two beams from a single laser beam, and a crystal to alter the wavelength.

FIG. 4 shows two prior art technologies used in the present invention to (1) alter the frequency of the laser beam and (2) split the beam from a single laser 40 into two parallel beams. Partially silvered mirror 13 splits the beam from laser 40, permitting approximately 50% of the energy to pass through the top aperture. Beam splitter 13 also directs another 50% of the beam to reflect off fully silvered mirror 14 and to pass through the lower aperture. Before reaching the splitter, the beam generated by laser 40 passes through a crystal 12 that alters the frequency to produce an ultra-violet beam, which UV beam is then split, trained on a target, and used to conduct a high-voltage stun charge.

The present invention recites two different types of apparati, both of which deliver a high-voltage stun charge to a distant target by means of conductive paths of ionized air, but each apparatus delivers the high voltage stun charge in different ways: The preferred embodiment (shown in FIGS. 3 and 5) is the two-conductor delivery. The two-conductor delivery method uses two widely separated laser-generated columns of ionized air to deliver oppositely charged electric voltages. When these two oppositely charged conductive columns contact the target, the electric circuit is completed through the target, imparting an incapacitating electric shock. The second recited apparatus (shown in FIGS. 6, 7, 8B, and 8C) is the single-conductor delivery. The single-conductor delivery method brings the columns of ionized air very close together, creating an overlapping "halo" region of ionized air between the laser beams. In contrast to the first recited apparatus, single-conductor embodiment uses a single high-voltage electrode connected electrically to both laser-generated columns of ionized air and to the overlapping "halo" region between the two laser beams. A shock is delivered by the simple expedient of electrically connecting two terminals with vastly different electrical potentials (the million-volt high-voltage electrode 63 and the target 200 with neutral or minimal electrical potential).

Figure 5:
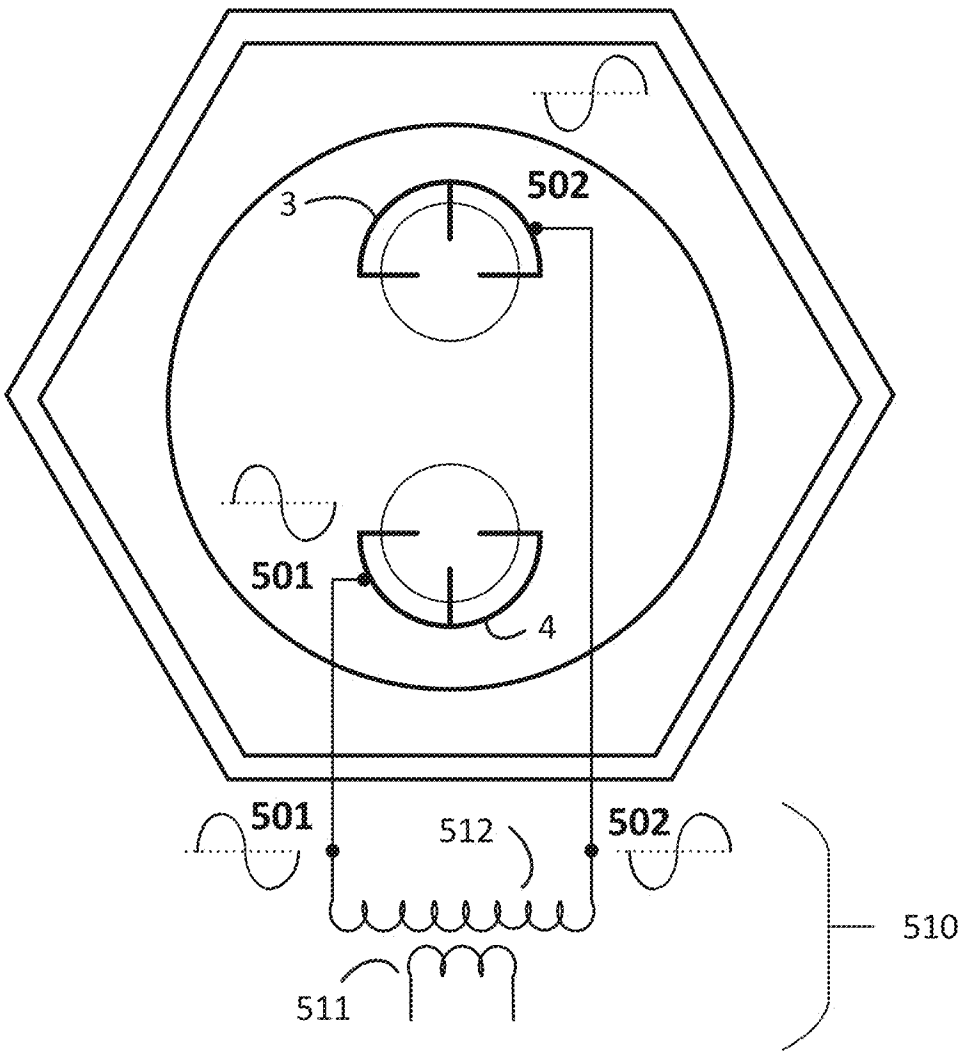
FIG. 5 is a front view of the muzzle of the laser stun gun according to the embodiments pictured in FIG. 3 illustrating that the high-voltage electrode 501 is charged with AC voltage that is 180 degrees out of phase with the other high-voltage electrode 502.

The preferred embodiment shown in FIG. 5 delivers a high-voltage stun charge via two separate laser-produced gaseous conductive paths emanating from laser stun gun 100. FIG. 3 illustrates how this two-conductor embodiment creates both a delivery and a return path for an electrical circuit through living target 200.

Power lasers 1, 2 are activated by circuit(s) separate from the high-voltage "stun" circuit, which terminates at high-voltage electrodes 3 and 4. Power lasers 1, 2 create two columns of ionized air extending to the target, creating a path for the stun charge to run through human target 200. From the viewpoint of the high-voltage charge on electrode 3, there is less resistance through target 200 and back to electrode 4 via the "return" conductive path created by power laser 2, than the large electrical resistance that exists across the air gap between electrodes 3 and 4.

FIG. 5 illustrates the out-of-phase relationship of the alternating current (AC) electrical stun charge as it is applied to the two stun electrodes 3 and 4. Electrode 4 is connected to terminal 501 of secondary coil 512 of the stun circuit's output power transformer. As illustrated, the voltage on electrode 4 is positive in the first half of the AC cycle. Electrode 3, on the other hand, is connected to terminal 502 of secondary coil 512. The voltage applied to electrode 3 during the same time period is negative in the first half of the AC cycle. This essentially maximizes the voltage differential of the stun charge.

The second recited apparatus is the single-conductor delivery that is illustrated in FIGS. 6, 7, 8B, and 8C.

Figure 6:
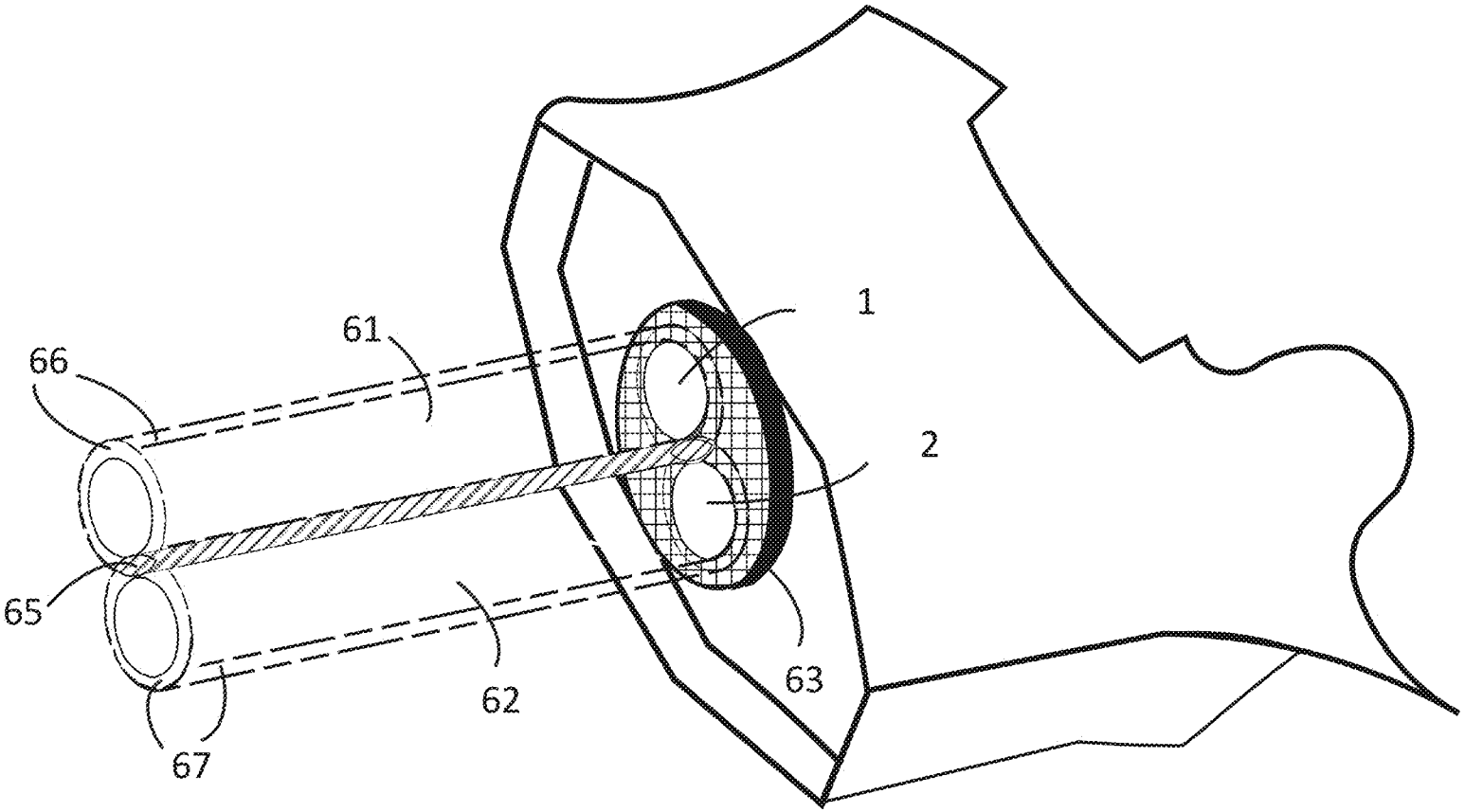
FIG. 6 is a closeup of the muzzle of the laser stun gun showing a conductive mesh electrode carrying the high-voltage stun charge, said mesh electrode surrounding two laser apertures in close proximity to each other, according to an alternative embodiment.
Figure 7:
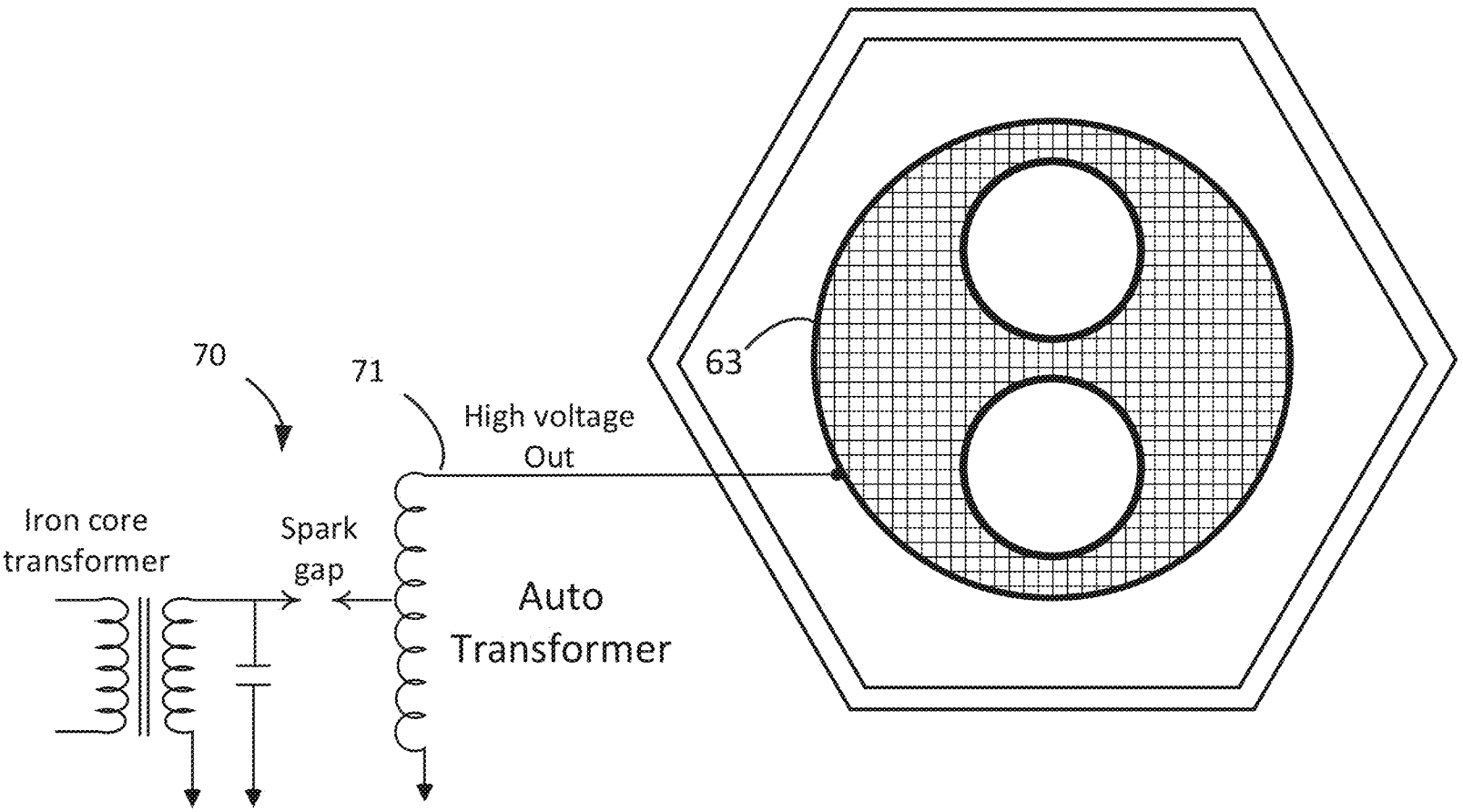
FIG. 7 is a front view of the muzzle of the laser stun gun of FIG. 6, showing a simplified schematic of the high-voltage circuitry that applies the stun charge to the conductive mesh.

FIG. 6 shows a perspective view of an alternate embodiment that uses two laser beams 61 and 62 with a single high-voltage stun electrode 63 situated between and around the apertures for lasers 1, 2. Electrode 63 connects the high-voltage stun charge to both ion-rich conductive paths 61, 62 generated by laser beams 1, 2. In the embodiments of FIGS. 6 and 7, high-voltage electrode 63 is composed of a conductive metallic mesh.

As noted above, the atmospheric columns of air directly in the path of the laser beams become strongly ionized conductive paths 61, 62, but the laser beams 1, 2 also produce a secondary "halo" layer of ionized air molecules 66, 67, which extends out in a short radius from conductive paths 61, 62 along the entire length of the cylindrical plasma paths 61, 62. It's similar in configuration to a sleeve of insulation surrounding a length of bell wire. When the halo regions of two or more beams are close enough to overlap, the overlap produces a reinforced "kernel" 65 of highly concentrated conductive ions extending to target 200.

High-voltage mesh electrode 63 is large enough to enclose the apertures from multiple lasers 1, 2; it connects the high-voltage stun charge simultaneously to electrically conductive gaseous paths 61, 62, and to concentrated halo region 65. A virtual "lightning strike" is delivered from high-voltage electrode 63, even without establishing a return path to electric circuit 70 in FIG. 7, because, with an originating stun voltage in the millions of volts, a portion of the charge inevitably gets routed down-trough to target 200. Two factors affect the electrical charge that ultimately impacts target 200: (1) the resistance of the conductive gaseous paths 61, 62 and (2) the target's resistance to ground.

(1) Laser stun gun 100 originates a high-voltage charge of more than a million volts. The electrical potential delivered to the target via conductive gaseous paths 61, 62 is variable, based on distance, water vapor, dust and particulates in the air, the power setting of laser stun gun 100, and other factors.

Target 200's resistance to ground also varies depending on terrain, footwear, dry or wet conditions, etc. However, as with a lightning strike, the voltage differential between laser stun gun 100 and the target at the moment device 100 is fired is so vast that a transitory charge sufficient to temporarily stun or incapacitate will be routed to the target.

When a person touches a conductor attached to a very high voltage source, as in FIG. 7, that person will receive a powerful shock. Lightning frequently strikes buildings made of brick, wood, and stucco. Lightning strikes trees, automobiles (insulated from the ground by inflated tires), and, unfortunately, lightning strikes humans with devastating effect. These ground-based objects may have nearly neutral electrical charges, but the huge voltage differential between a cloud mass with millions of volts of electrical charge and a ground-based object that comes into electrical contact with the thundercloud will guarantee a lightning strike.

Laser stun gun 100 mimics the operation of a lightning strike. It produces a "leader" of ionized air that opens a conductive path, then launches a non-fatal high-voltage "strike" that is transmitted immediately to the object at the other end of that "leader."

FIG. 7 is a front closeup view of the embodiment of the laser stun gun shown in FIG. 6. In this embodiment, stun electrode 63 is connected to the high side of secondary coil 71 of the auto-transformer of the stun circuitry.

Figure 8A:
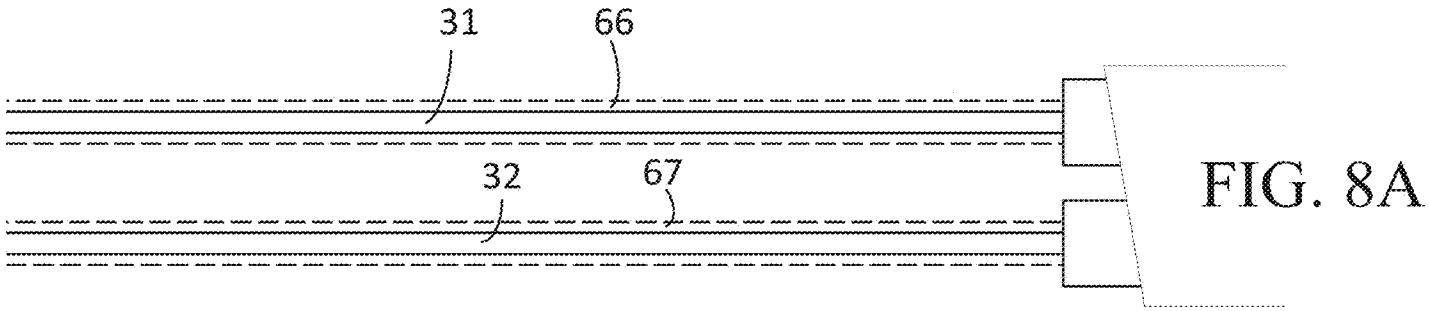
FIG. 8A is a side view of the beams produced by the laser stun gun showing that the beams are widely separated and completely parallel; also shown in side view is the thin "halo" region of ionized gas surrounding the laser beams.

FIG. 8A is a side view of the two-conductor delivery embodiment of laser stun gun 100. Two parallel laser beams 31, 32 are separated widely enough from each other that halo regions 66, 67 do not overlap. In this embodiment, conductive path 31 is connected electrically to one side of AC stun charge 502. Conductive path 32 is connected electrically to the other side of AC stun charge 501. Conductive path 32 carries a high-voltage AC charge that is 180 degrees out of phase with conductive path 31. Thus, when a living target comes into contact with both conductive paths 31 and 32, the circuit is completed, and the high-voltage charge is delivered.

Figure 8B:
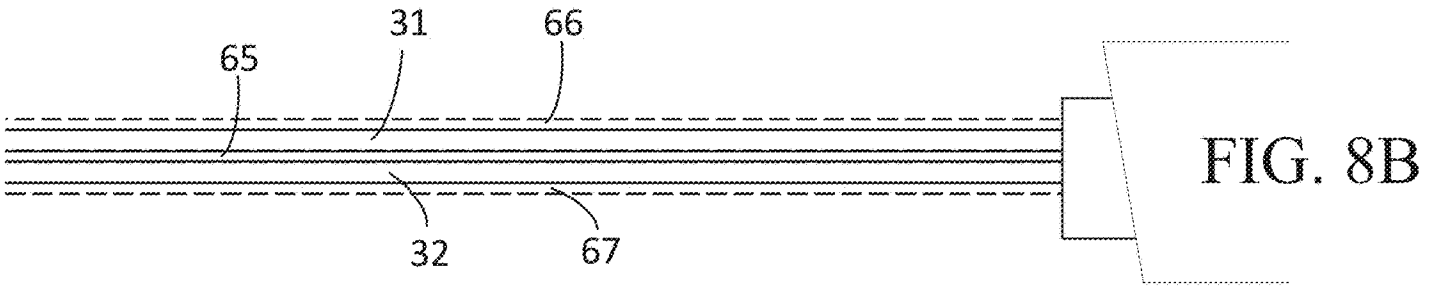
FIG. 8B is a side view of the laser beams of FIG. 8A with the beams very close together and completely parallel; also shown in side view is the area 1015 where two "halo" regions of ionized gas overlap.
Figure 8C:
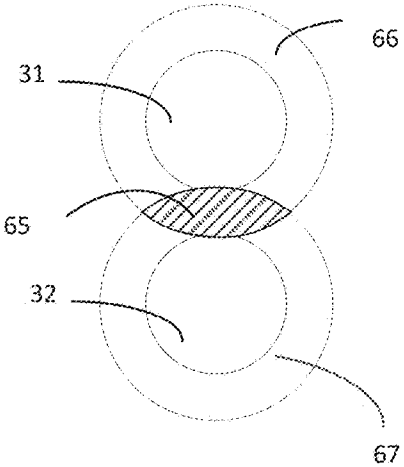
FIG. 8C is a front view of the laser beams of FIG. 8B showing the area 1015 where two "halo" regions of ionized gas overlap.

FIG. 8B, on the other hand, shows a side view of the single-conductor delivery embodiment. Two parallel laser beams 31, 32 are situated very close together, so halo regions 66, 67 do, in fact, overlap to form overlapping kernel region 65. In this embodiment, both conductive paths 31 and 32 are connected electrically to the high-voltage out terminal 71 of auto transformer 70 (see FIG. 7). FIG. 8B is a front view of the single-conductor embodiment pictured in FIG. 8B.

FIG. 9 is a closeup front view of the muzzle of another embodiment of laser stun gun 100. This embodiment uses gaseous nitrogen as the lasing material enclosed in a long rectangular tube. The front view of FIG. 9 shows rectangular discharge aperture 905. Central electrode 910 and laser charging electrodes 920, 930 run the entire length of power laser 900. In FIG. 9, the front end of central electrode 910 and the front ends of laser-charging electrodes 920, 930 are shown. Central electrode 910 is negatively charged and serves as the electrical ground return for laser charging-electrodes 920, 930. Additionally, in this embodiment, central electrode 910 is also the high-voltage out terminal 71 of high-voltage auto transformer 70, which provides the stun charge.

Figure 10:
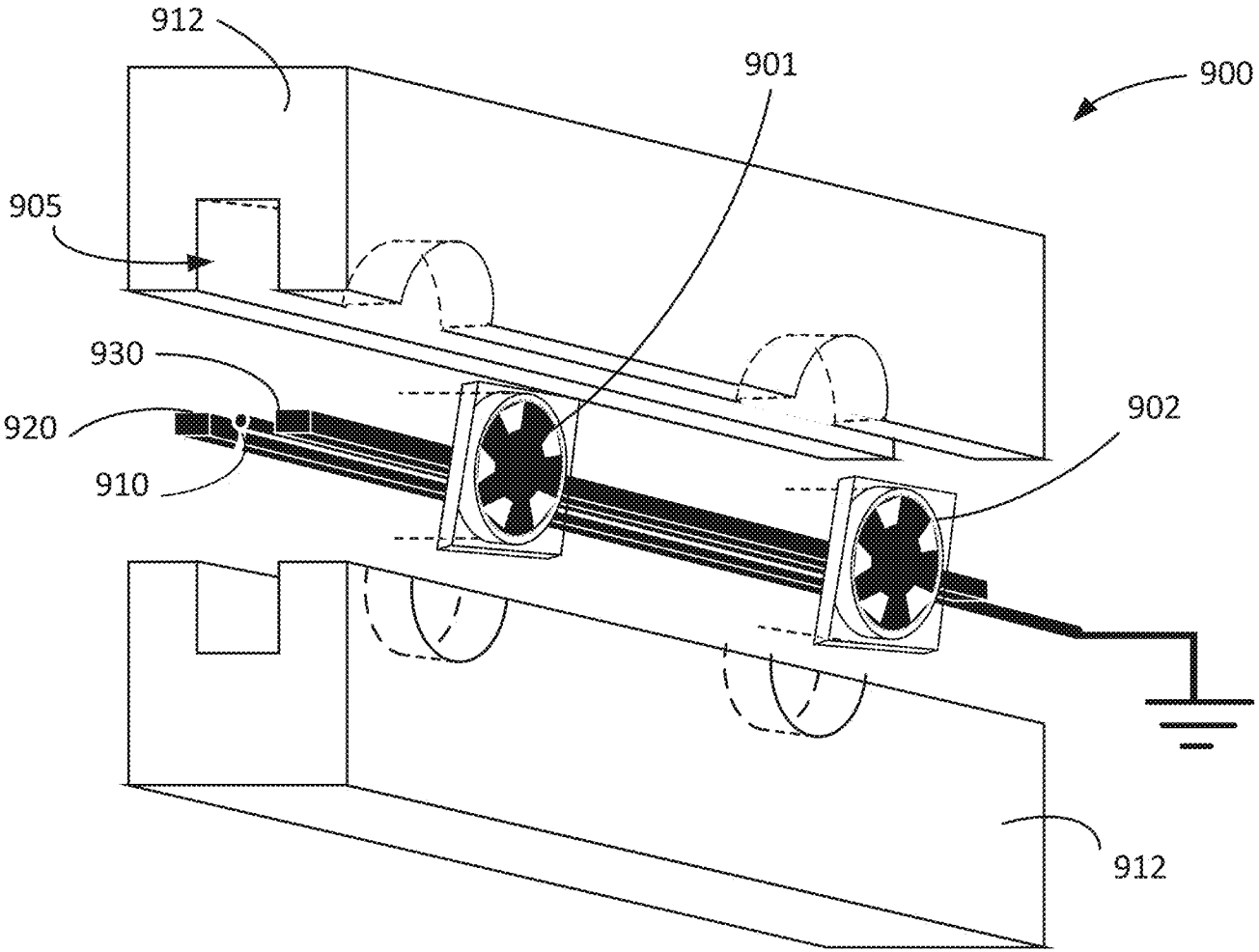
FIG. 10 is an exploded perspective view of the rectangular gaseous laser shown in FIG. 9.

FIG. 10 is an exploded perspective view of the embodiment in FIG. 8, showing the fans that provide a fresh supply of atmospheric nitrogen to the laser. Laser charging electrodes 920, 930 run the length of the laser tube on either side of central electrode 910. Central electrode 910 is a threaded metallic rod that runs through the middle of rectangular laser tube 905. Laser charging electrodes 920, 930 are partially embedded into insulating material 912, which surrounds the nitrogen gas and forms the rectangular column that is laser chamber 905. Laser charging electrodes 920, 930 conduct electricity to the $N_2$ gas, thus charging the laser.

The rectangular chamber of power laser 900 is filled mostly with nitrogen gas. Actually, in this embodiment, the laser tube contains a constantly refreshed supply of atmospheric air, which is comprised of 79% nitrogen ($N_2$). A threaded metallic ground rod (central electrode 910) runs the length of the laser chamber and provides an electrical path for the laser charging circuitry.

Small muffin fans 901, 902 pump air (mostly nitrogen) through openings in insulator 912 to provide fresh supplies of $N_2$ to the laser. The power levels to fans 901 and 902 respectively are differentially regulated to increase or decrease gas pressure in laser chamber 905.

Figure 11C:
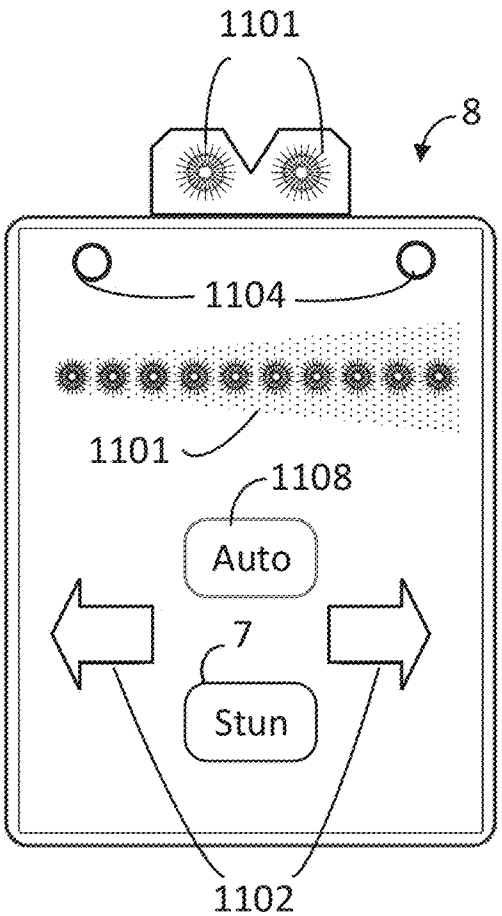
FIG. 11C depicts the handle of a laser stun gun with a user display, showing that the high voltage circuit is set to 100% (full power stun) two green lights on the rear sight indicate that a target has been acquired and is in range; at this point, the sighting laser is on, painting a red spot on the target exactly where the stun charge will strike; pressing the stun button will fire the laser stun gun.
Figure 11B:
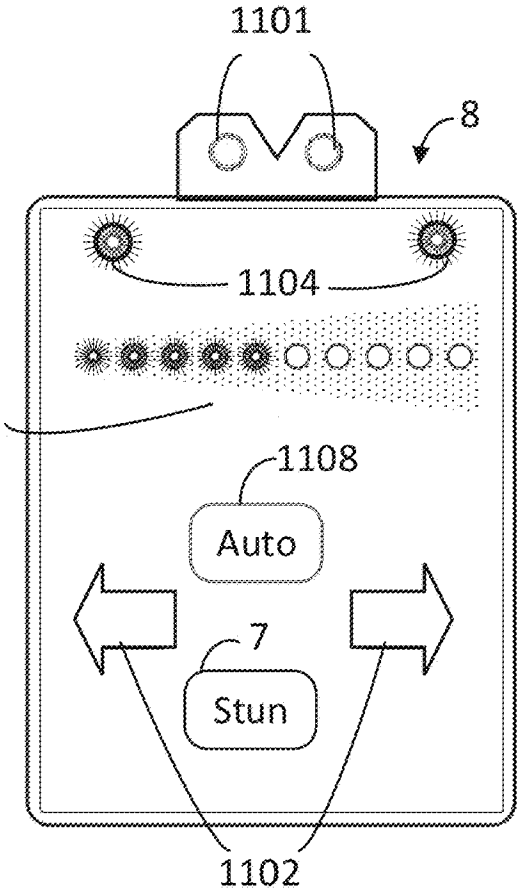
FIG. 11B depicts the handle of a laser stun gun with a user display, showing that the high voltage circuit is set to 50% charge (stun level is half power); two yellow lights are lit to indicate that no target is yet in range
Figure 11A:
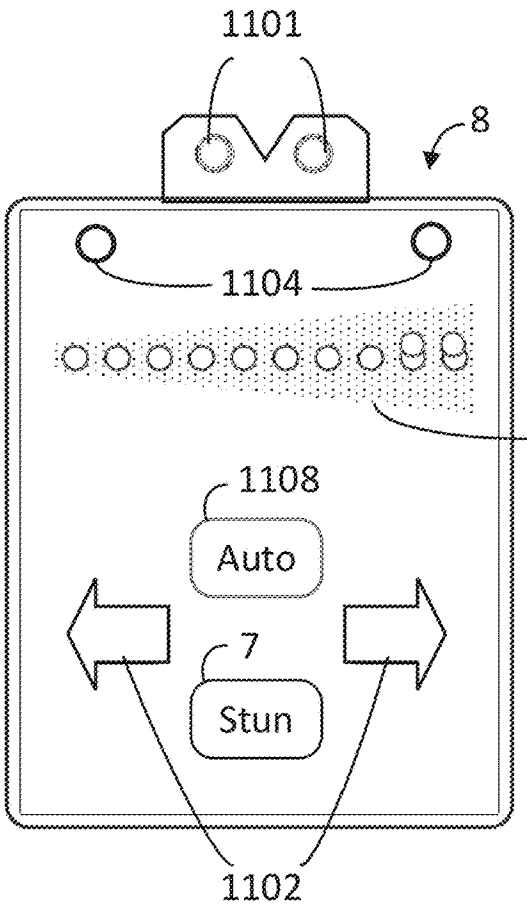
FIG. 11A depicts the handle of a laser stun gun with a user display, showing that the weapon is off; unlit lights show that the high voltage circuit is not activated, according to an embodiment.

FIGS. 11A, 11B, and 11C show an embodiment of user display and control console 8. FIG. 11A shows laser stun gun 100 when all power is off. Power level lights 1101 are not lit, the yellow "no target in range" or "no-shot" lights 1104 are not lit, and the green "target acquired" lights 1101 on the rear sight are likewise off. This all-off condition occurs when the gun is holstered (in which case the automatic safety circuit 9 shown in FIG. 1 is in the "safety on" condition).

The all-off condition may also occur when the stun gun 100 is drawn, but no stun level has been selected. For the nitrogen gas embodiment of laser stun gun 100 depicted in FIGS. 9 and 10, the fans 901, 902 that provide air to the power laser 805 will be running any time laser stun gun 100 is unholstered.

FIG. 11B depicts a condition in which the user has used power level selection arrows 1102 to select 50% stun level, as shown by half the power level lights 1101 being lit. Yellow no-shot lights 1104 are lit, indicating that no target is yet within range.

FIG. 11C depicts a condition in which the user has used power level selection arrows 1102 to select 100% stun level, as shown by all the power level lights 1101 being lit. No-shot lights 1104 are have been turned off, and green "Ready" lights 1101 on the rear sight are lit, indicating that a target is in range and has been acquired. The user may press the large Stun button 7 to fire the device. Actually, when any stun level has been selected by selector arrows 1102, pressing the Stun button 7, will fire device 100, even if no-shot 1104 lights are lit.

The Auto button 1108 in FIGS. 11A-11C does just what the name implies: Pressing Auto button 1108 initiates continuous or near-continuous firing of the laser and the high-voltage stun circuitry, with performance analogous to the "full auto" setting on an automatic rifle or machine pistol.

Laser stun gun 100 can operate continuously for prolonged periods as long as the power supply holds out. In initial designs, a 3.7 volt battery was used to power the laser. Larger batteries may be used, and battery power may be augmented by connecting to additional batteries in a backpack, fanny pack, etc.

Figure 12B:
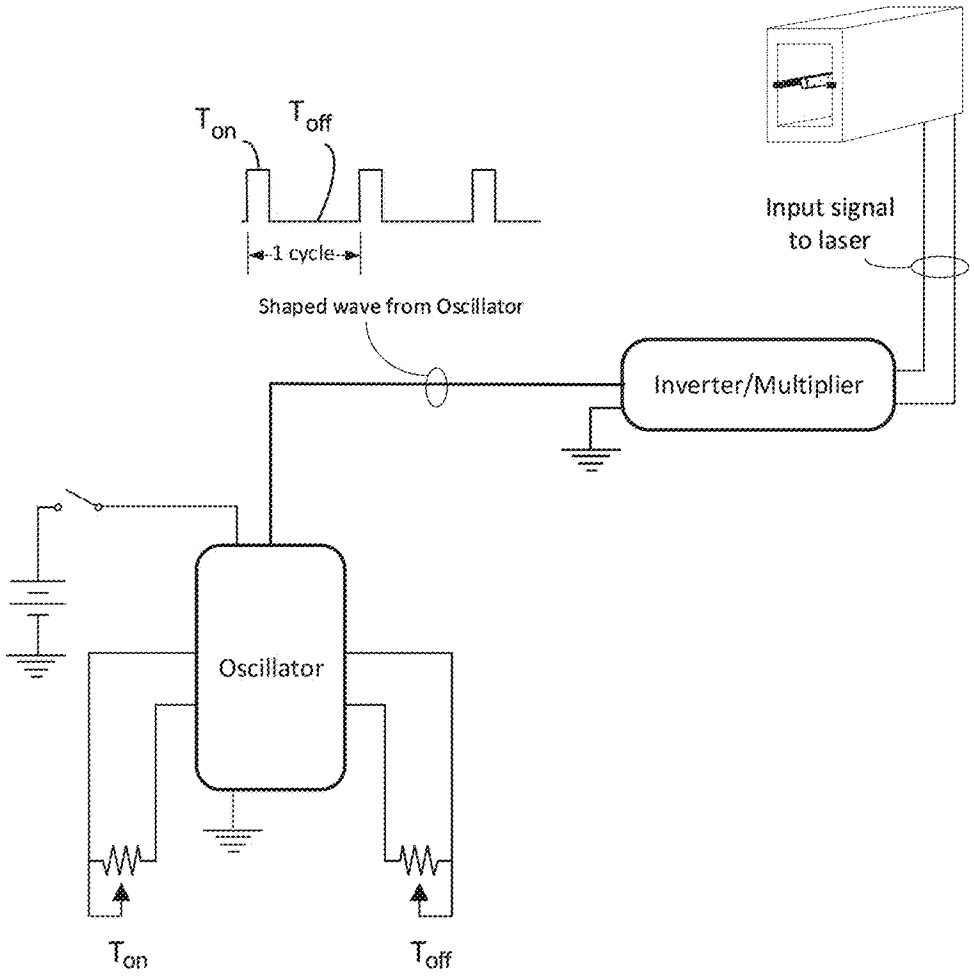
FIG. 12B shows controls for the oscillator that provides a pulsed signal to activate the laser(s); using controls for Ton and Toff, the manufacturer can adjust the duty cycle to optimize the power of the laser when it fires, according to the embodiment shown.
Figure 12A:
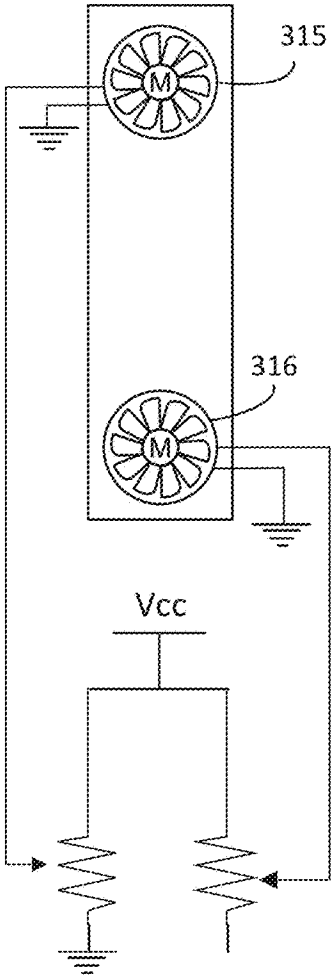
FIG. 12A is a block diagram of controls for the fans that supply nitrogen to the gaseous laser, according to the embodiment shown in FIG. 9.

FIG. 12B shows how the laser output can be maximized by adjusting the $T_{on}$ and $T_{off}$ settings of the oscillator to shape the pulsed signal that controls and activates the laser's gaussian duty cycle. The duty cycle affects output peak of the laser. The shorter the duty cycle, the higher the peak power of the laser. Thus, shortening the duty cycle of the laser's pulsed input signal is a way of optimizing the laser output per cycle, in this embodiment. This conserves battery power. The $T_{on}$ and $T_{off}$ settings that establish the duty cycle are set during manufacturing and testing; these are not adjustments made by the user.

The output portion of this high-voltage stun circuit is represented by the system-level circuit depiction in FIG. 7. In initial designs, a separate 3.7 volt battery powers auto transformer circuit 70. This battery may be augmented as well. An oscillator/amplifier unit ramps the battery power up to more than a million volts to generate the stun charge. However, each high-voltage discharge uses a very small amount of current, so that a fully charged battery can produce a long stuttering series of electrical sparks that happen far more rapidly than a conventional gun's mechanical process of ejecting a spent shell and chambering a new round. Such a rapid-fire series of high-voltage flashes may appear almost continuous.

These three performance factors (1) laser output optimized with small duty cycle, (2) high-voltage stun charges generated instantly with minimal battery current, and (3) (in the in the nitrogen-based laser embodiment) a constantly refreshed supply of nitrogen lasing material—these three factors enable laser stun gun 100 to generate a virtually continuous stream of stuttering man-made "lightning flashes" that temporarily disables living targets. While using the Auto feature 1108, laser stun gun 100 can be swept in an arc, delivering stun charges over a wide area to multiple targets.

Referring now to no shot lights 1104 and target acquired lights 1101, FIG. 9 shows some prior art range-finding technologies that enable laser stun gun 100 to provide this information to the user. Targeting laser 5 and range finder system 6 are located on the exterior housing shown in FIG. 9, both well back from the discharge end of laser unit 805.

Sighting laser 5 "paints" the target at the exact location where the stun charge will be delivered, as is now done with targeting lasers used as accessories to conventional guns. The dot of the targeting laser may also alert a potential target to danger, perhaps convincing him to cease his current behavior to avoid being fired upon—again, similar to this technology's use with conventional weapons.

But targeting laser 5 has additional importance when used with the present invention: It allows unmatched precision for the disabling stun shot. The user need not calculate how far a projectile will drop over the distance to the target, nor compensate for wind or a moving target. The lit-up spot you see is what you shoot. There is no need to "lead" a running or moving suspect, as is necessary with projectile weapons. The laser flash 31, 32 travels at the same speed of light as the targeting laser, and the mini "lightning strike" high voltage discharge follows milliseconds later. So the user merely "lights up" target 200 with targeting laser 5 while the Stun 7 or Auto 1108 button is depressed.

As with sighting laser 5, range finding system 6 is clearly prior art. For greater certainty in distance to a target, range finding system 6 uses LIDAR (an acronym for light detection and ranging) 950 and an ultrasound range finder 940. Information from these systems illuminates LEDs on the user console display 8 to give the user "No shot" 1104 or "Ready" 1101 before he takes a shot. Alternately (or additionally) the LIDAR unit can give a readout of distance.

The essential job of the laser beam(s) 12 is to create a conductive path or paths of rarified air (plasma) from the laser stun gun 100 to the target 200. As mentioned earlier, the laser(s) 40, 900 in the present invention are not meant to burn or destroy flesh or property. Once the plasma paths are established by laser, a non-lethal high voltage electrical charge like those used in Tasers® and conventional stun guns, is transmitted via the plasma paths to target 200. Those skilled in the art will recognize that such plasma paths may be produced by several types of lasers capable of being housed in handheld unit 100.

In one embodiment, a solid state laser of the Nd:YAG type (neodymium-doped yttrium aluminum garnet; $Nd:Y_3Al_5O_{12}$) is used as a lasing medium to output an infrared beam as either a steady beam or in pulsed mode. In another embodiment, a carbon dioxide ($CO_2$) power laser produces an infrared beam to ionize the air. In yet another embodiment nitrogen gas produces an ultraviolet beam. Whatever laser source is used, the wavelength can be modified to produce maximum ionization by the use of crystals, as depicted in FIG. 4.

Conductive paths between laser stun gun 100 and target 200 may also be produced by different geometrical arrangements of laser beams. The two laser beams 1, 2 may be produced by a single laser (as shown in FIG. 4) or by two separate lasers. Those skilled in the art will also recognize that different numbers of lasers and different geometries of laser-beam arrangements can be used to create a gaseous conductive path to target 200. A single laser using a single beam can be used in the single-conductor embodiments shown in FIGS. 6, 7, 9, and 10. Likewise, multiple lasers and different geometries of laser-beam arrangements can be used to create a halo-overlap region 65 of highly conductive ions. An example an alternate laser geometry is the U.S. Navy's LaWS laser weapon, mentioned earlier, which consists of six welding lasers strapped together to produce enough heat to damage targets. The present invention, as noted repeatedly, does not damage living targets, but rather uses lasers to create columns of ion-rich conductive air between the device 100 and target 200. Nevertheless, such alternate geometric arrangements of multiple lasers can be used to establish or strengthen the necessary columns of ion-rich conductive air.

The specifics and details of the embodiments described herein shall not be construed in any way to limit Applicant's claims to the design, theory, novel steps, or operation of the present invention. The present drawings and written description are meant to communicate to one skilled in the relevant art, information necessary to understand and implement Applicant's invention. Said drawings and written descriptions are fully intended to claim, protect and include any and all variations within the scope and spirit of the concepts set forth herein.

The invention claimed is:

1. An apparatus for delivering an incapacitating electrical stun charge to a living organism at a distance, said apparatus comprising at least one power laser and a high-voltage electrical circuit, wherein the at least one power laser creates two beams of coherent light that ionize atmospheric air in two paths to a distant target, thus bringing into existence two columns of ion-rich gaseous plasma extending through the air, said ionized plasma paths capable of conducting electrical charge;

said laser beams are precisely parallel to each other;

the two columns of ion-rich gaseous plasma are spaced far enough apart that no electricity can flow between them;

the two laser beams are aimed at a living human or non-human target;

said high voltage electrical circuit produces a high voltage alternating current stun charge and presents this charge to two electrodes situated in close proximity to, and extending into, the two ionized plasma paths;

the high-voltage AC charges on the two electrodes are 180 degrees out of phase with each other; and said high-voltage electrical charges are transmitted via the two conductive paths of ion-charged air to the living human or non-human target, completing the circuit through said target, and delivering an electrical stun charge sufficient in voltage, time sequence, and frequency to temporarily incapacitate the target.

2. The apparatus of claim 1 further comprising at least one range finding means is incorporated into the device to provide a user with information about distance to target, and No Shot and Ready To Fire conditions, which information is presented on the user interface display module.

3. The apparatus of claim 2 wherein at least one of the range finding means is laser-based ranging technology.

4. The apparatus of claim 2 wherein at least one of the range finding means employs ultrasound technology.

5. The apparatus of claim 1 wherein the wavelength of the laser beam is 287.5 nm.

6. The apparatus of claim 1 wherein the two beams of coherent light that ionize atmospheric air are produced by a single laser producing a single beam, and said beam is split into two parallel beams.

7. The apparatus according to claim 1 wherein the at least one power laser is from the group of lasers that includes: an ultraviolet gaseous laser of the nitrogen $N_2$ type; an ultraviolet gaseous laser of the mostly nitrogen $N_2$ type which employs a constantly refreshed supply of atmospheric air, 79% of which is comprised of nitrogen $N_2$; a gaseous laser of the carbon dioxide $CO_2$ type; and a solid state laser of the Nd:YAG type (neodymium-doped yttrium aluminum garnet [Nd:$Y_3Al_5O_{12}$]).

8. The apparatus according to claim 1, wherein the laser-generated beams of coherent light that ionize atmospheric air in columnar paths to a distant target are created and sustained in existence either for a brief few seconds or for a prolonged period;

the high-voltage charge is conducted to the living target either for a brief few seconds or for a prolonged period; such that the laser stun gun provides a sustained auto firing feature, similar in duration and purpose to the full automatic feature of conventional mechanical automatic weapons.

9. An apparatus for delivering an incapacitating electrical stun charge to a living organism at a distance, said apparatus comprising at least one power laser and a high-voltage electrical circuit, wherein the at least one power laser creates two beams of coherent light that ionize atmospheric air in two columnar paths to a distant target, thus bringing into existence two columns of ion-rich gaseous plasma extending through the air, said ionized plasma paths capable of conducting electrical charge;

the laser beams are precisely parallel to each other;

said ion-rich gaseous plasma columns generate thin halo-like regions of ionized gas on their outer periphery;

said columns of ion-rich gaseous plasma are spaced very closely together so that the halo regions of the plasma columns touch and overlap;

the two laser beams are aimed at a living human or non-human target;

said high voltage electrical circuit produces a high voltage stun charge and presents this charge to a single large electrode that is in contact with the overlapping halo region of ionized gas between the laser beams, and that is also in close proximity to the two ionized plasma paths themselves; and said high-voltage electrical charge is conducted via the two conductive columns of ionized gas produced by the lasers, and also via said overlapping halo region of ion-charged air between the laser beams, to the living human or non-human target, thereby delivering an electrical stun charge sufficient in voltage, time sequence, and frequency to temporarily incapacitate the target.

10. The apparatus of claim 9 wherein the at least one power laser produces a single beam of coherent light that ionizes atmospheric air in a single column of ion-rich gas, surrounded at the column's periphery by a thin halo of ionized gas, which column of ion-rich gas, together with its gaseous ionized halo, conducts said high-voltage charge to the living target.

11. The apparatus of claim 9 wherein the at least one power laser produces three or more beams of coherent light that ionize atmospheric air, thus producing multiple columns of ion-rich gas, surrounded at each column's periphery by a thin halo of ionized gas, wherein said multiple ionized plasma columns are arranged closely together in geometric patterns such that the columns' peripheral halos of ionized gas touch and overlap, creating a highly conductive kernel region or regions, each column of ion-rich gas, together with its gaseous ionized halo, conducts a high-voltage charge to the living target, and said overlapping halo region of ion-charged air between the multiple laser beams also conducts the high-voltage charge to the living target, thereby delivering an electrical stun charge sufficient in voltage, time sequence, and frequency to temporarily incapacitate the target.

12. The apparatus according to claim 9 wherein the g least one power laser is from the group of lasers that includes: an ultraviolet gaseous laser of the nitrogen $N_2$ type, an ultraviolet gaseous laser of the mostly nitrogen $N_2$ type which employs a constantly refreshed supply of atmospheric air, 79% of which is comprised of nitrogen $N_2$; a gaseous laser of the carbon dioxide $CO_2$ type; and a solid state laser of the Nd:YAG type (neodymium-doped yttrium aluminum garnet [Nd:$Y_3Al_5O_{12}$]).

13. The apparatus according to claim 9, wherein the laser-generated beams of coherent light that ionize atmospheric air in columnar paths to a distant target are created and sustained in existence either for a brief few seconds or for a prolonged period;

the high-voltage charge is conducted to the living target either for a brief few seconds or for a prolonged period; such that the laser stun gun provides a sustained auto firing feature, similar in duration and purpose to the full automatic feature of conventional mechanical automatic weapons.

14. A system for delivering an incapacitating electrical stun charge to a living organism at a distance comprising at least one power laser and a high-voltage electrical circuit, wherein:

the at least one power laser creates two beams of coherent light that ionize atmospheric air in two paths to a distant target, thus bringing into existence two columns of ion-rich gaseous plasma extending through the air, said ionized plasma paths capable of conducting electrical charge;

said laser beams are precisely parallel to each other;

the two columns of ion-rich gaseous plasma are spaced far enough apart that no electricity can flow between them;

the two laser beams are aimed at a living human or non-human target;

said high voltage electrical circuit produces a high voltage alternating current stun charge and presents this charge to two electrodes situated in close proximity to, and extending into, the two ionized plasma paths;

the high-voltage AC charges on the two electrodes are 180 degrees out of phase with each other; and said high-voltage electrical charges are transmitted via the two conductive paths of ion-charged air to the living human or non-human target, completing the circuit through said target, and delivering an electrical stun charge sufficient in voltage, time sequence, and frequency to temporarily incapacitate the target.

15. The system of claim 14 wherein the wavelength of the laser beam is 287.5 nm.

16. The system of claim 14 further comprising at least one range finding means is incorporated into the device to provide a user with information about distance to target, and No Shot and Ready To Fire conditions, which information is presented on the user interface display module.

17. The system of claim 16 wherein at least one of the range finding means is laser-based ranging technology.

18. The system of claim 16 wherein at least one of the range finding means employs ultrasound technology.

19. The system according to claim 14, wherein the laser-generated beams of coherent light that ionize atmospheric air in columnar paths to a distant target are created and sustained in existence either for a brief few seconds or for a prolonged period;

the high-voltage charge is conducted to the living target either for a brief few seconds or for a prolonged period; such that the laser stun gun provides a sustained auto firing feature, similar in duration and purpose to the full automatic feature of conventional mechanical automatic weapons.

* * * * *